United States Patent [19]

Malkki et al.

[11] Patent Number: 4,892,622

[45] Date of Patent: Jan. 9, 1990

[54] METHOD FOR RESISTING FORMATION OF UNDULATIONS IN A FIBER/WATER MIXTURE DURING FORMING OF A PAPER WEB IN A PAPER-MAKING MACHINE

[75] Inventors: Raimo Malkki; Paavo Jaatinen, both of Lappeenranta; Timo Haverinen; Pekka Eskelinen, both of Turku; Juhani Jokinen, Masku; Vesa Vuorinen; Raimo Virta, both of Turku; Martti Salmivaara, Littoinen, all of Finland

[73] Assignees: Valmet Oy; Kymmene Oy, both of Finland

[21] Appl. No.: 87,400

[22] Filed: Aug. 20, 1987

[30] Foreign Application Priority Data

Aug. 22, 1986 [FI] Finland ..... 863411

[51] Int. Cl.[4] ..... D21F 1/00

[52] U.S. Cl. ..... 162/208; 162/207; 162/297

[58] Field of Search ..... 162/207, 208, 198, 297

[56] References Cited

U.S. PATENT DOCUMENTS

| | | | |
|---|---|---|---|
| 1,563,095 | 11/1925 | Lewthwaite | 162/208 |
| 1,989,435 | 1/1935 | Wallquist | 162/208 |
| 2,716,927 | 9/1955 | Sullivan | 162/252 |
| 3,989,085 | 11/1976 | Crosby | 162/208 |

FOREIGN PATENT DOCUMENTS 270227 2/1914 Fed. Rep. of Germany .

*Primary Examiner*—Karen Hastings

*Attorney, Agent, or Firm*—Steinberg & Raskin

[57] ABSTRACT

A method of and arrangement for resisting formation of undulations in a fiber/water mixture supplied onto a forming wire at an open planar wire section of a paper-making machine include establishing over the wire an air curtain extending over the full breadth thereof, in the region of which the air mass upon the wire is set in motion. The direction of movement of the air mass is the same as the traveling direction of the wire, and the velocity of the air substantially equals the speed of the wire. The air curtain commences on the planar wire section, in the machine direction, only at a given distance from a lip slice of a headbox of the machine, and the air curtain extends along the traveling direction of the web over the planar wire section over a given distance.

9 Claims, 4 Drawing Sheets

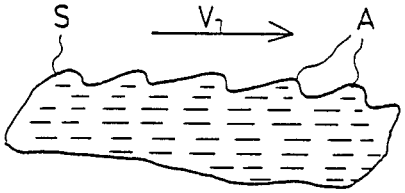
FIG. 1A
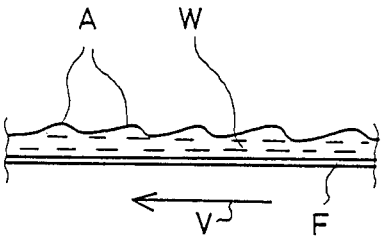
FIG. 1B
FIG. 1
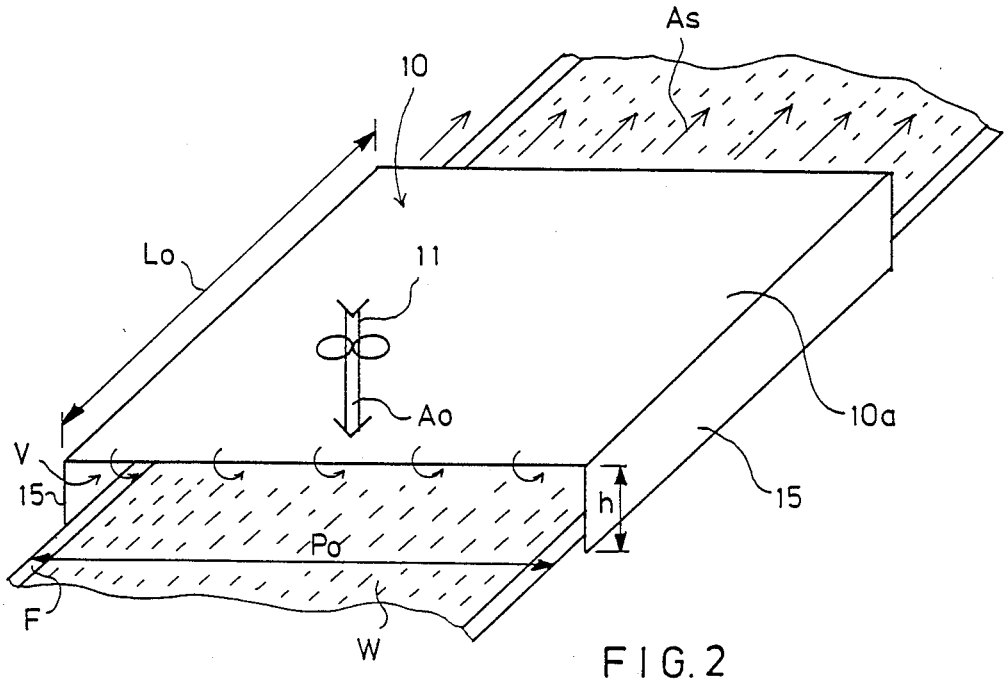
FIG. 2

METHOD FOR RESISTING FORMATION OF UNDULATIONS IN A FIBER/WATER MIXTURE DURING FORMING OF A PAPER WEB IN A PAPER-MAKING MACHINE

BACKGROUND OF THE INVENTION

The present invention generally relates to a method of and an arrangement for improving the forming of a generally uniform paper web at an open wire or forming section of a paper-making machine, particularly where a fiber/water mixture supported by a forming wire at the forming section is advanced at high speeds which are on the order of 1000 m/min or higher.

As known in the art, the headbox of a paper machine spreads a dilute, 0.2 to 1.2% fiber/water mixture to form a layer as homogeneous as possible on a forming wire, or in a throat defined between two forming wires. Couching of the fibers to form a uniform paper web takes place in the wire or forming section, the water being drained and removed through the fiber array.

Between the outer free surface of the fiber/ water mixture moving along with the wire and the air which is stationary above the wire, there is a differential velocity equal to the speed of the wire. This differential velocity may cause undulations in the fiber/water mixture, the same phenomenon as waves on a water surface in windy weather.

Such undulations in the fiber/water mixture on the wire are disadvantageous, because they usually result in non-uniform formation of the paper web, which causes uneven letterpress printing. The undulation effect usually becomes particularly objectionable at a web speed about 1000 m/min, and it increases with increasing speed. In some instances, this undesirable undulation effect may, in fact, become a limiting factor restricting the paper machine speed.

Reference is made to the U.S. Pat. Nos. 1,563,095 and 2,716,927, and to the German Reichspatent No. 270,227, in which certain arrangements are disclosed with which a planar wire is covered and/or in which air jets are blown on top of the open planar wire. However, the mode of operation, the end use of those arrangements, as well as the design, differ considerably from the invention disclosed and claimed here.

In addition, it may be noted that at the time when the above-cited prior art patents were granted, the speeds of paper machine wires were so low that the undulation, the detrimental effects of which the present invention aims to eliminate, did not even occur, at least to no objectionable extent. Also, the quality requirements imposed on paper at that time were rather less exacting as a consequence of the letterpresses then in use.

SUMMARY OF THE INVENTION

The object of the present invention is to provide a novel method and arrangement with which the above-described detrimental undulation phenomena of a fiber/water mixture occurring on a forming wire can be minimized, if not prevented. For achieving this aim, and other aims which will become apparent later on, this invention is mainly characterized in that undulations in the fiber/water mixture supplied onto the wire through a lip slice aperture of a headbox of a paper-making machine are minimized, if not prevented, by establishing above the forming wire an air curtain extending over the entire width thereof, the air mass directly above and upon the wire in the region of said air curtain being set in motion in the same direction along which the wire travels at a web velocity, and at an air velocity which substantially equals the web velocity.

The arrangement comprises a blow box extending over the whole breadth of the wire and forming an air channel through which the fiber/water mixture passes in contact with the moving air curtain. The blow box is connected with feed conduits for feeding blow air into the air channel. The blow box is provided with a plurality of nozzles transverse to the traveling or advancement direction of the wire. The nozzles are successively arranged along the advancement direction. Jets of air are blown through the nozzles into the air channel formed between the blow box and the wire to form the moving air curtain which moves along the traveling direction of the wire at a velocity substantially the same as the speed with which the wire moves. The moving air curtain blankets the fiber/water mixture, and the tendency of undulations to form is minimized due to the small, if not negligible, differential velocity between the air velocity of the moving air curtain and the web velocity of the fiber/water mixture.

The present invention may be performed on Fourdrinier wire sections, that is, on planar wire sections, or on so-called hybrid wire sections, said last-mentioned having a single wire at an initial part of the forming zone or station, on which the web has time to acquire a certain degree of couching before moving on to a twin-wire forming zone, where dewatering is effected through two opposed wires.

The method and arrangement of the present invention are advantageously performed at the station in which so much water has been drained through the wire that the consistency of the fiber/water suspension is in the range from 1.2 to 4.5%, preferably in the range $k_a$ from 1.5 to 3.5%. The method and the arrangement of the invention will then act most efficiently toward avoiding non-uniformity in the completed paper web caused by undulations in the fiber/water suspension.

In planar wire sections, the action of the air curtain of the invention is arranged to commence no earlier than at least about 2 m from the lip slice of the headbox.

The longitudinal distance along the advancement direction in which the air curtain of the invention is active is usually in the range from 2 to 8 m, preferably in the range of about 3 to 6 m.

The height of the air curtain channel of the invention is usually advantageously between 100 and 300 mm, preferably between 150 and 250 mm.

The air velocity $v_l$ in the air curtain channel of the invention is advantageously $v_l = (1 + \pm 0.1) \times v_o$, where $v_o$ is the velocity of the wire and the web supported thereon.

The novel features which are considered as characteristic of the invention are set forth in particular below. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIGS. 1A and 1B are schematic views illustrating the generation of undulations;

FIG. 2 is a perspective schematic view of the invention;

DETAILED DESCRIPTION OF THE PREFERRED EMBODIMENTS

Figure 3:
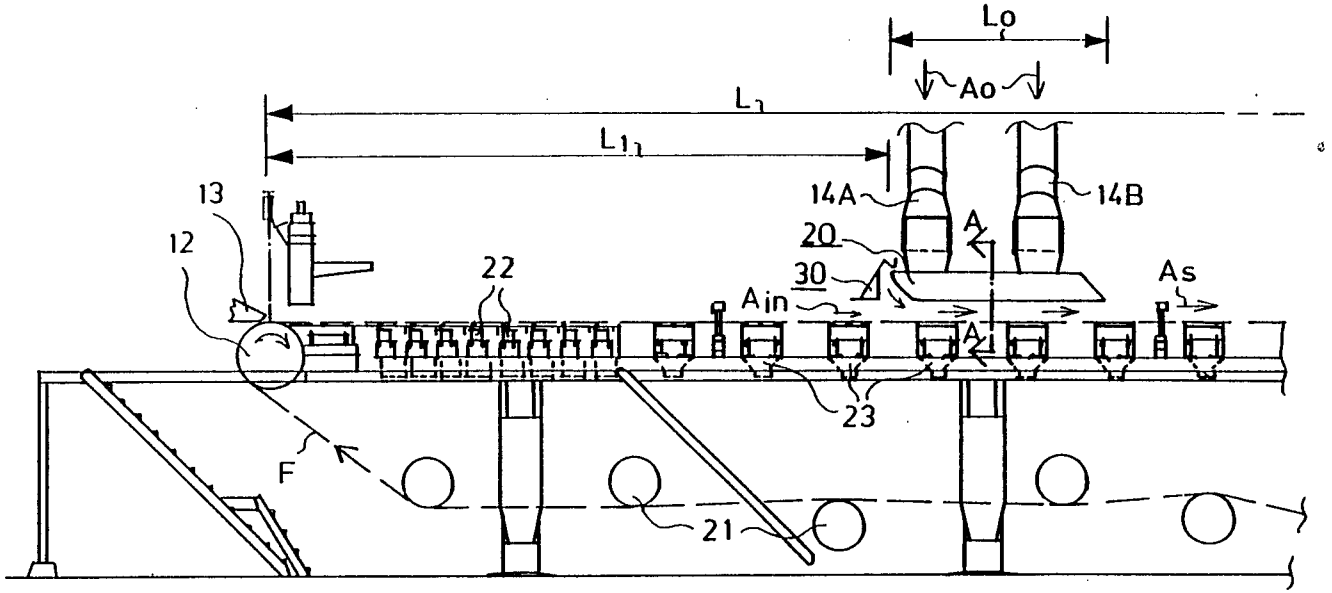
FIG. 3 is a side view of a forming wire station of a paper-making machine in which the invention is used.

FIGS. 1A and 1B illustrate how undulations A are formed in a fiber/water mixture W supported on a forming wire F jointly advanced at a web velocity v in a high-speed paper-making machine. In general, if there is a gas flow over an exposed surface S of a stationary liquid (FIG. 1A), the surface S of the liquid begins to undulate due to the differential velocity between the liquid and the gas flow. At a forming wire section of a paper-making machine (FIG. 1B), the fiber/water mixture W rests on a wire F and moves at the same speed v as the wire F. Therefore, a differential velocity exists between the moving fiber/water mixture W and the air which is stationary thereabove. This differential velocity produces undulations or waves A in the fiber/ water mixture W of very low consistency, in the same way as a gas flowing above the liquid surface causes waves in FIG. 1A.

As taught by the invention, undulations in the fiber/-water mixture W (hereinafter, for simplicity, being referred to as the web W) lying on the wire F are minimized, if not prevented, by establishing over the wire F an air curtain as schematically depicted in FIG. 2. The air curtain 10 blankets an outer, exposed, free surface of the web W and has a breadth equaling the width ($p_o$) of the whole wire (F). The air curtain 10 covers longitudinally about 10 to 30% of the length L of the planar wire section (see FIG. 3). Thus, in the region of the air curtain 10, the air directly above the outer surface of the web is forced, as taught by the invention, to move in the same direction as the wire F at an air velocity $v_l$ which is substantially the same as the web velocity $v_o$ of the wire F. Preferably, $v_l=(1\pm0.1)v_o$. Hence, no appreciable differential velocity will then arise between the moving web W and the moving air curtain thereabove, thereby minimizing the build-up of any objectionable undulations.

For producing the moving air curtain 10, an air channel or passage V is provided on the wire section. A lower side of the channel is bounded by the wire F and the web W thereon. An upper side of the channel is bounded by a base wall 10*a* of a blow box 20. Lower portions of side walls 15 of the blow box 20 complete the air channel which has a rectangular cross-section.

Blow air is introduced into the channel V with the aid of blower means schematically identified by reference numeral 11 in FIG. 2. With the aid of appropriately shaped nozzles (see nozzles 17*a* –17*i* in FIG. 5), the blow air is made to move in the advancement direction of the wire F and substantially at the same velocity as the wire F. The channel V need only extend over a comparatively short distance $L_o$ in the longitudinal direction of the wire F since, after the passage V, the air will continue to flow on in the same direction and with nearly the same velocity as the wire F and the web W. The distance $L_o$ is usually in the range $L_o=2$ to 8 m, preferably $L_o=3$ to 6 m.

FIG. 3 shows a forming wire section of a paper-making machine in which a blow box 20 is located to constitute an air-moving station. The fiber/water mixture is supplied to the paper-making machine through a lip slice 13 of a conventional headbox onto the wire F at the location of a breast roll 12. The blow box 20 of the invention is located at a distance $L_l$ from the lip slice 13 of the headbox. The blow box operation would not be as efficient if it were located closer to the headbox, and the blow box would be rapidly soiled by splashing of the fiber/water mixture and become unusable. Blow air from a non-illustrated pressurized air supply is carried to the box 20 in the direction of arrows $A_o$ through air conduits 14A and 14B.

Figure 4:
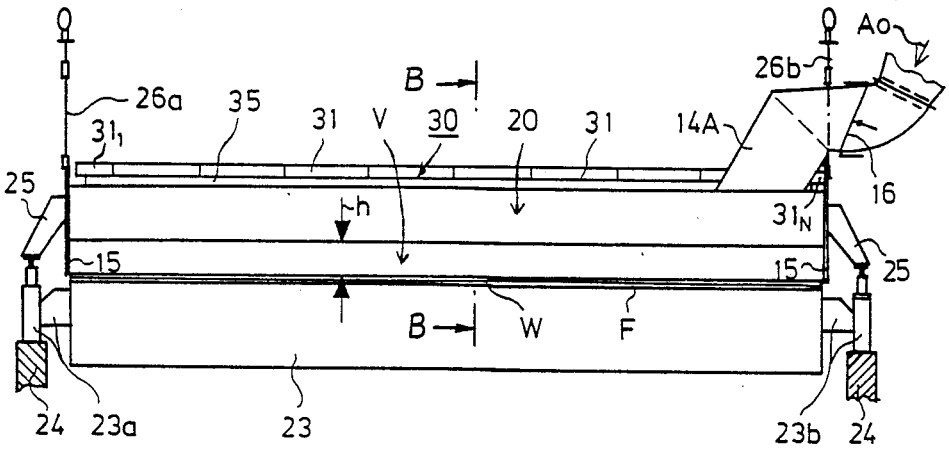
FIG. 4 is an enlarged sectional view taken on line A—A of FIG. 3.
Figure 5:
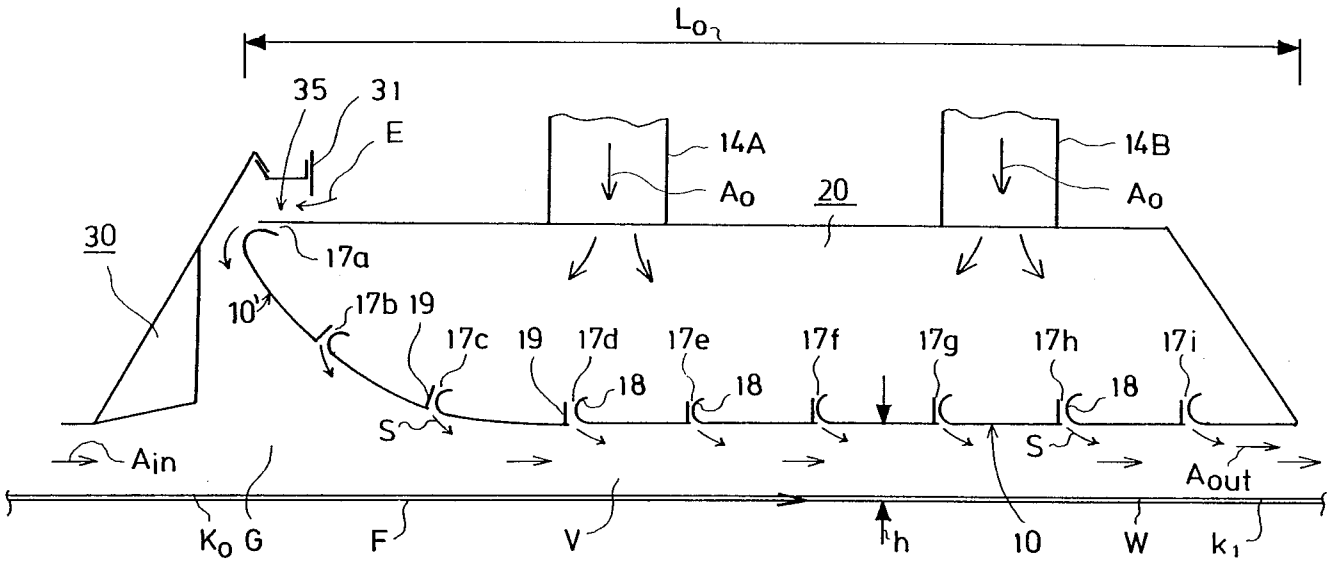
FIG. 5 is an enlarged sectional view taken on line B—B of FIG. 4.

FIGS. 4 and 5 show the blow box 20 in enlarged view. The blow box has a planar upper wall above the base wall 10*a*. The upper and base walls together with upper portions of the side walls 15 bound an interior chamber with which the air conduits 14A, 14B are in communication. The blow box 20 is attached at the upper portions of the side walls 15 with beams 25 to the frame parts or foundation elements 24 of the paper-making machine. Suction assemblies 23 for the wire section are mounted by cantilever components 23*a* and 23*b*. Foil strips 22 and guide rolls 21 for the wire F are also shown in the initial part of the wire section in FIG. 3.

In FIGS. 3 and 5, the lower portions of the side walls 15 of the air channel V, visible in FIG. 4, have been omitted for the sake of clarity. The air conduits 14A and 14B are connected to the box 20 and do not interfere when the box 20 is lifted off the web, e.g. during changing of the wire. In the horizontal run of the air conduits 14A and 14B, an air-lock, also known as a quick-lock 16, visible in FIG. 4, has been inserted. As shown in FIG. 4, the box 20 is attached to lifting wires 26*a* and 26*b*.

FIG. 5 displays in greater enlarged detail an advantageous structural example of the blow box 20. The box 20 has in its base wall 10*a* a plurality of nozzle slits 17*a* –17*i* successively arranged along the traveling direction of the wire F, each nozzle slit extending transversely across the whole breadth $p_o$ of the wire F. One confining surface 18 of each nozzle slit has been shaped to be a curved Coanda surface, and the other confining surface is a straight planar sheet 19. Blow air fed by conduits 14A, 14B enters the interior of the blow box 20 and emerges as air jets S following each curved guide surface 18. At the exterior of the nozzle slits, the air jets S turn to become substantially parallel with the direction of travel of the wire. The base wall 10*a* includes an initial guide wall 10' which itself has also been shaped to form a curved throat G. The radius of curvature of the curved wall 10' is advantageously in the range from 500 to 700 mm. Another function of the jets at nozzles 17*a* –17*c* the curved wall 10' is to keep the front of the box 20 clean of splashes from the fiber/water mixture thereat.

The air jets S issue at a high velocity and pressure from the nozzles of the blow box. The air jets set the air mass in the air channel V between the base wall 10*a* and the wire F in motion. The air mass continues to flow through and past the channel in the advancement direction together with the wire F even after exiting the box (see arrows $A_{out}$ and $A_s$).

As taught by the invention, the length $L_o$ of the moving air curtain in the advancement direction is usually in the range $L_o=2$ to 8 m, preferably $L_o=3$ to 6 m. The height h of the base wall 10*a* from the upper surface of the web W is h =100 to 300mm, preferably h =150 to 250 mm.

As taught by the invention, the air curtain is only commenced at a considerable distance $L_l$ from the lip slice 13 of the headbox. $L_l$ is greater than 2 meters, and can be from 3–15 meters. In the region $L_o$, of the box 20 air jets are injected into the air curtain channel V with a velocity high enough to make them persist in the direction of the arrow $A_s$ for a considerable distance even after the active region proper, $L_o$, of the box 20, preferably all the way up to the so-called dry line of the web W, or adjacent thereto, where the web W contains no more free water and the web W has acquired a degree of couching such that its fibers can no longer move relative to each other. The air curtain may extend, at least with a reduced, lower velocity, even up to the end of the planar wire section, or in hybrid formers, to the beginning of the twin-wire zone.

In an upstream part of the blow box 20, a separate air guide 30 is provided, its purpose being to afford improved control over the air flow E at the upstream part of the box 20. At the same time, the air guide 30 collects most of the pulp droplets splashed from the wire F. The air guide 30 is mounted so that it can be detached for ease of cleaning.

Figure 6:
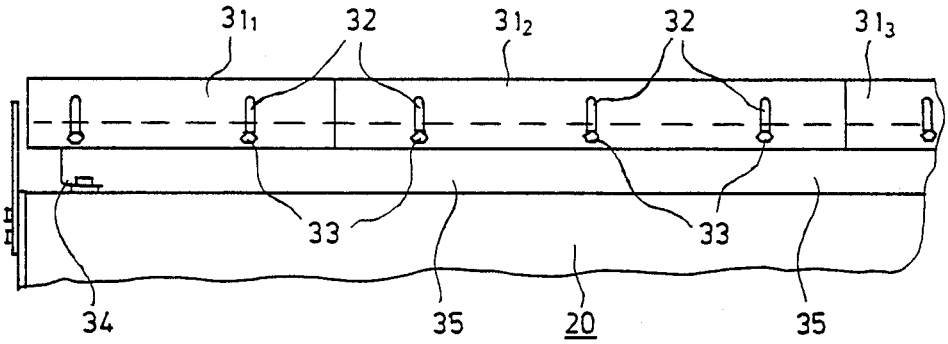
FIG. 6 is an enlarged view of a detail of the invention.

The upstream air flow E passing through the space 35 formed between the air guide 30 and upstream parts of the blow box 20 is controlled with a control plate or gate 31 mounted on the air guide 30. The control plate 31 is divided into a number of gate sections $31_1$, $31_2$, $31_3$–$31_N$ along the breadth direction of the wire F (FIG. 6), each of them separately adjustably mounted on the guide 30 and settable in position with the aid of vertically elongated slots 32 in the gate sections and set screws 33. Since the velocity of the air curtain produced by the box 20 is decisively dependent on the air flow E between the air guide 30 and the blow box 20, it is possible to equalize velocity differentials, arising from local circumstances, with the aid of the gate sections of the control plate 31 on the air guide 30. The air guide 30 is mounted on the blow box 20 with support members.

It will be understood that each of the elements described above, or two or more together, also may find a useful application in other types of constructions differing from the types described above.

While the invention has been illustrated and described as embodied in a method of and arrangement for resisting formation of undulations in a fiber/water mixture during forming of a paper web in a paper-making machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within in the meaning and range of equivalence of the invention.

We claim:

1. A method of resisting formation of undulations in a fiber/water mixture supported by a forming wire during forming of a paper web in a high-speed, paper-making process, comprising the steps of:

jointly advancing the fiber/water mixture and the forming wire during the forming of the paper web along an advancement path at a web velocity; and moving a mass of air directly above and extending over a direction transverse to said advancement path, in the same direction as said advancing of the fiber/water mixture and only partly along said advancement path during forming of the paper web, and at an air velocity generally equal in magnitude to said web velocity;

wherein said moving step is commenced at a point downstream of commencement of said joint advancing step;

wherein the advancing and moving steps are performed at web and air velocities on the order of 1000 m/min and higher;

directing the mass of air substantially over the entire width of the web;

wherein the advancing step is performed in a paper-making machine of the type having a forming station at which the fiber/water mixture is supplied from a lip slice of a headbox onto the forming wire;

wherein the moving step is performed at an air-moving station within the forming station;

wherein the moving step includes the steps of commencing a flow of air mass at a predetermined location downstream of the lip slice, and continuing the air mass flow over a predetermined distance along the advancement path;

wherein the commencing step is performed at said predetermined location which is greater than two meters from the lip slice; and wherein the moving step includes feeding air into and through the air-moving station, and forming a moving air curtain which blankets the fiber/water mixture within and exiting the air-moving station, and the moving air curtain is formed by feeding air through a plurality of nozzles successively arranged along the advancement path, each nozzle extending along the transverse direction to emit air across the width of the fiber/water mixture.

2. The method according to claim 1, wherein the moving step is performed such that the magnitude of the air velocity lies within a range having one end limit which is ten percent below, and another end limit which is ten percent above, the magnitude of the web velocity.

3. The method according to claim 1, wherein the air mass flow is continued over said predetermined distance which lies in a range from two to eight meters.

4. The method according to claim 3, wherein said predetermined location lies in a range from three meters to fifteen meters, and said predetermined distance lies in a range from three to six meters.

5. The method according to claim 1, wherein the moving step is performed by moving the air mass which extends upwardly from an upper surface of the fiber/water mixture at the air-moving station for a height lying in a range from 100 to 300 mm.

6. The method according to claim 5, wherein said height lies in the range from 150 to 250 mm.

7. The method according to claim 1, wherein the fiber/water mixture at the air-moving station has a consistency in a range from 1.2 to 4.5 %.

8. The method of claim 7, wherein the consistency is in the range of about 1.5 to 3.5 %.

9. The method according to claim 1, wherein the moving air curtain is also formed by guiding air through an inlet of the air-moving station, said inlet extending along the entire width of the fiber/water mixture; and further comprising the step of controlling the flow of guided air across the entire width of the fiber/water mixture within the air-moving station.

* * * * *